US006308965B1

(12) United States Patent
Yang

(10) Patent No.: US 6,308,965 B1
(45) Date of Patent: Oct. 30, 2001

(54) IN-LINE SKATE STRUCTURE

(76) Inventor: Lien-Chuan Yang, 11F-1, No. 149, Sec. 3, Roosevelt Rd., Taipei (TW)

( * ) Notice: Subject to any disclaimer, the term of this patent is extended or adjusted under 35 U.S.C. 154(b) by 0 days.

(21) Appl. No.: 09/375,422

(22) Filed: Aug. 17, 1999

(51) Int. Cl.[7] ..... A63C 17/20

(52) U.S. Cl. ..... 280/11.221; 280/11.223; 280/11.27; 280/11.3

(58) Field of Search ..... 280/11.19, 11.22, 280/11.221, 11.223, 11.224, 11.231, 11.25, 11.26, 11.27, 11.3; 292/256.67, 257

(56) References Cited

U.S. PATENT DOCUMENTS 3,007,706 * 11/1961 Pullen ..... 280/11.26
4,684,140 * 8/1987 Olivieri ..... 280/11.26
5,484,149 * 1/1996 Lee ..... 280/11.26
5,590,921 * 1/1997 Holtman et al. ..... 292/257
5,645,288 * 7/1997 Lu ..... 280/11.26
5,678,833 * 10/1997 Olson et al. ..... 280/11.224
5,890,723 * 4/1999 Benoit ..... 280/11.22

* cited by examiner

*Primary Examiner*—Lanna Mai
(74) *Attorney, Agent, or Firm*—Bacon & Thomas PLLC

(57) ABSTRACT

An adjustable in-line skate structure includes a frame and a boot including a toe section, a heel section and a cuff section. Adjustable means are provided for adjusting the toe portion with respect to the heel section and the cuff section. The adjustable means includes cooperating transverse teeth portions belonging to the toe section and the heel section, an insertion cavity and an insertion block, and an adjustment fastener assembly. The adjustment fastener assembly is provided for urging the insertion block to move upward along walls of the insertion cavity so as to loosen the transverse teeth portion of the toe section from the transverse teeth of the heel portion. A latch assembly is also provided to permit adjustment at a connection point of the toe section, heel section and cuff section.

4 Claims, 8 Drawing Sheets

IN-LINE SKATE STRUCTURE

BACKGROUND OF THE INVENTION

The present invention relates to an in-line skate structure, and more particularly, to a skate for children which is securely adjustable to accommodate a variety of shoe sizes. Normally, an adult in-line skate has a fixed foot structure. For children, however, there is a need to provide an adjustable skate since, as children grow, their feet expand. By accommodating the growth in foot size, an adjustable childrens' in-line skate provides a more comfortable skate and allows for longer use.

Various techniques have been provided to accommodate a foot size change in in-line skates. One technique is to accommodate the growth by having an oversized molded boot containing a replaceable boot liner. Liners of various sizes can be provided according to child's foot size. Another technique is to permit the boot of the skate to adjust. The heel portion has a sole plate which is carried over the length of the frame and is slidably attached to the toe portion so as to be adjustable in length. Often however, such an approach results in an insecure structure.

SUMMARY OF THE INVENTION

An object of the present invention is to provide an improved, adjustable in-line skate.

According to a preferred embodiment of the present invention, an in-line skate structure includes a frame and a boot composed of a toe section, a heel section and a cuff section. The sole of the toe portion is attached to the heel portion and an insertion block disposed in an insertion block cavity formed by the frame. The toe portion is arranged to be slidable in the longitudinal direction of the skate and releasably secured at fixed positions so as to permit an adjustment of the toe and heel portions.

Another element of the preferred embodiment of the present invention is a latch assembly that is used to adjust tightness of the connection of the toe section, the heel section and the cuff section. The toe portion is slidable relative to the heel section and the cuff section upon a loosening of the latch assembly and is fixed at a position upon tightening the latch assembly.

DETAILED DESCRIPTION OF THE PREFERRED EMBODIMENTS

Figure 1:
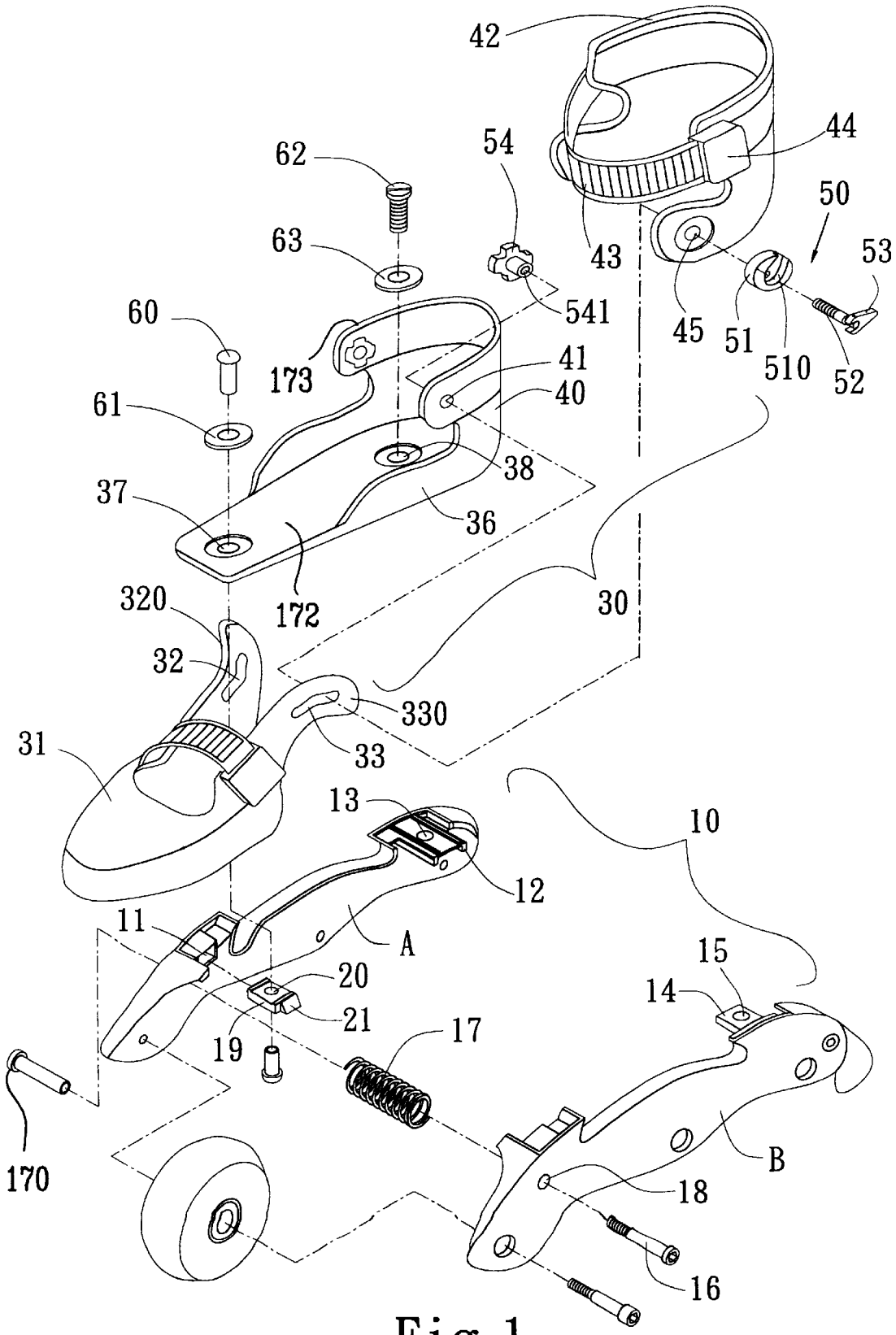
FIG. 1 is a perspective exploded view of the present invention.

The in-line skate of the present invention shown in FIG. 1 includes a frame 10 and a boot 30. The frame 10 includes two identical frame halves, A, B. The frame halves, A, B are slidably joined at the rear with complementary tongues 12, 14 and adjustable at the front with an adjustment fastener assembly 16, 17, 170.

Figure 3:
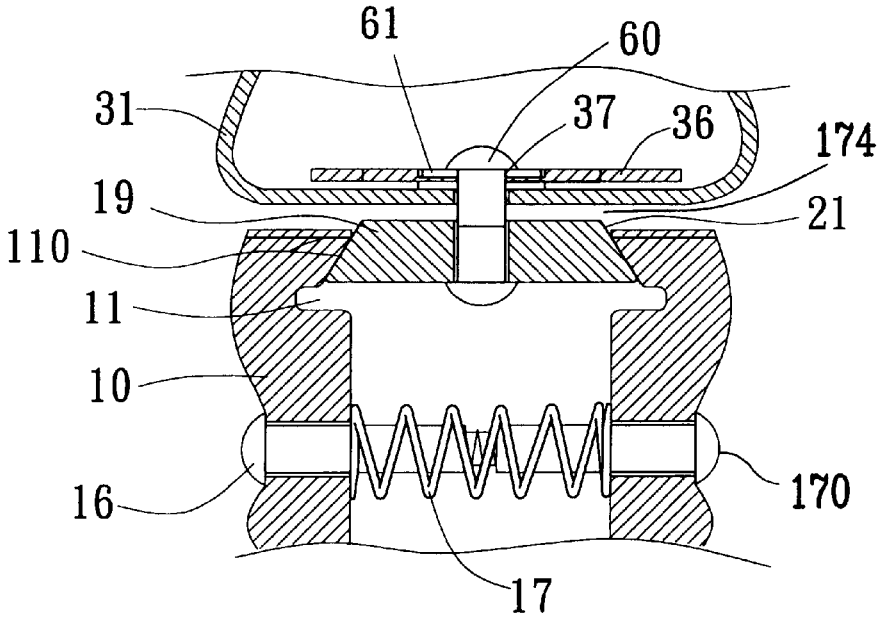
FIG. 3 is a transverse cross-sectional view of a lower portion of the skate showing a loosened adjustment fastener assembly.
Figure 4:
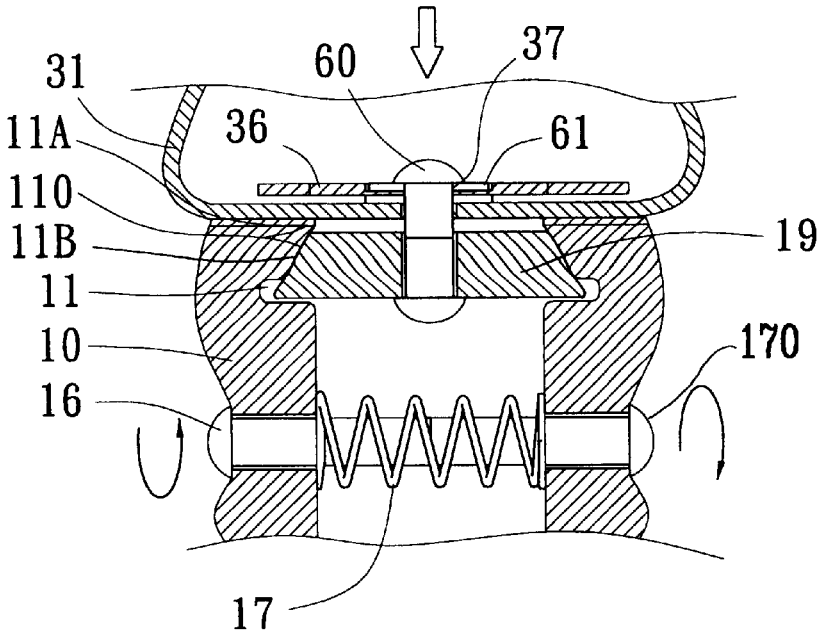
FIG. 4 is a transverse cross-sectional view of a lower portion of the skate showing a tightened adjustment fastener.

According to the examples shown in FIGS. 3 and 4, the frame halves A, B each have a portion near the front end that includes an insertion cavity 11 having acute slope surfaces 11B. An insertion block 19 having surfaces 21 complementary to the insertion cavity acute slope surfaces 11B cooperates with the acute slope surfaces 11B.

The adjustment fastener assembly comprises an adjustment fastener 16, a spring 17, and an elongated nut 170. The adjustment faster 16 extends transversely through one of the frame halves A, B and is received by the elongated nut 170 extending through another of the frame halves A, B. The spring 17 is coaxially mounted to the elongated nut 170 and the adjustment fastener 16, and interposed between the two frame halves A, B so as to exert a constant pressure against the inner surfaces of the frame halves A, B. Upon tightening the adjustment fastener 16, its action brings the frame halves A, B closer together by exerting a wedging effect between the surfaces 21 of the insertion block 19 and the acute slope surfaces of the insertion cavity 11B.

Figure 1A:
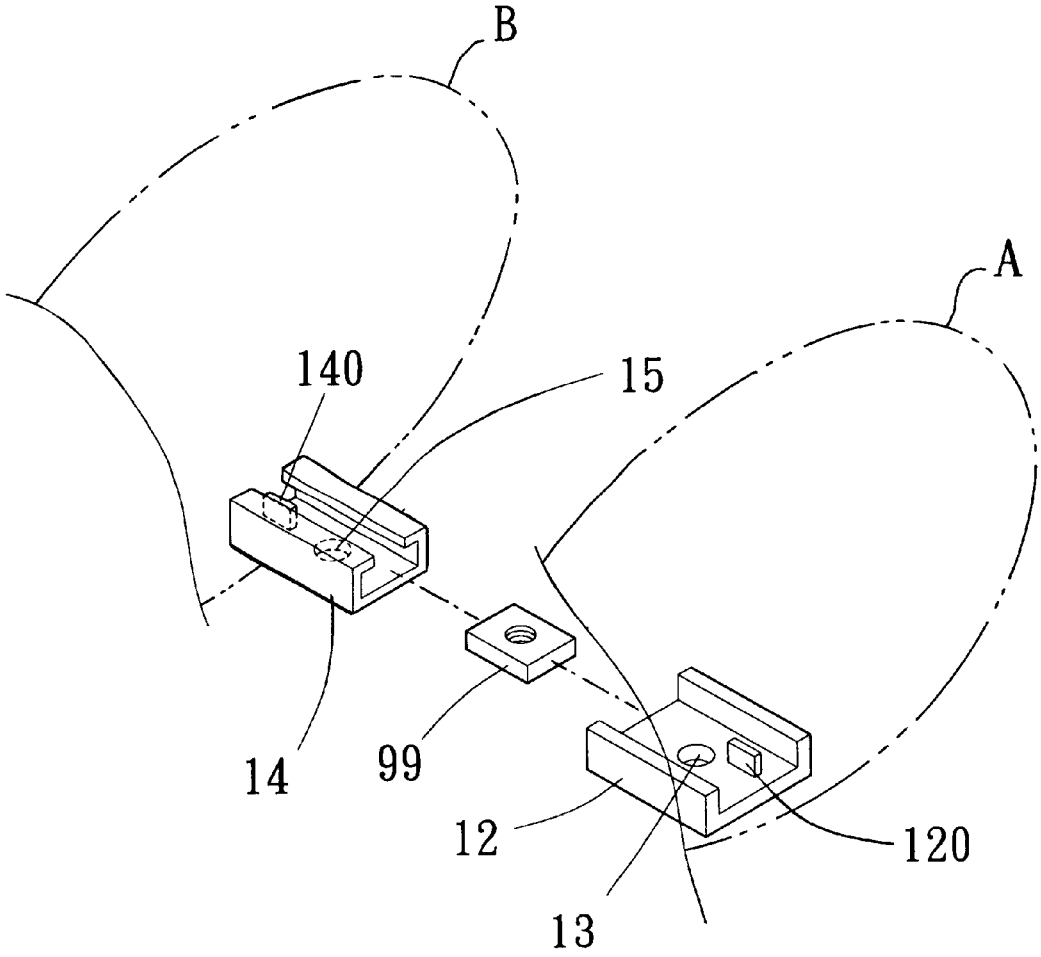
FIG. 1A is a perspective view from below of a heel portion of the present invention.

As shown in FIG. 1A, frame half A includes a U-shaped tongue 12 located near the rear end of frame half A and protrudes transversely to the longitudinal direction of the skate. The U-shaped tongue 12 forms a hole 13 centrally located thereon and a stopping protrusion 120 located at an end of the U-shaped tongue 12 near frame half A. Frame half B also includes a U-shaped tongue 14 that cooperates with the complementary-shaped U-shaped tongue 12. U-shaped tongue 14 also forms a hole 15 centrally located thereon and a stopping protrusion 140 located at an end of the Ushaped tongue 14 near frame half B. The U-shaped tongue 14 has two oppositely opposed sides that are each bent inwards to form two bending walls. The U-shaped tongue 12 cooperates with U-shaped tongue 14 to form a platform that defines a rectangular socket. As shown in FIG. 1A, a rectangular nut 99 is inserted into the rectangular socket and surrounded by the walls of U-shaped tongue 14. Movement of the rectangular nut 99 is limited by the stopping protrusions 120, 140.

Figure 2:
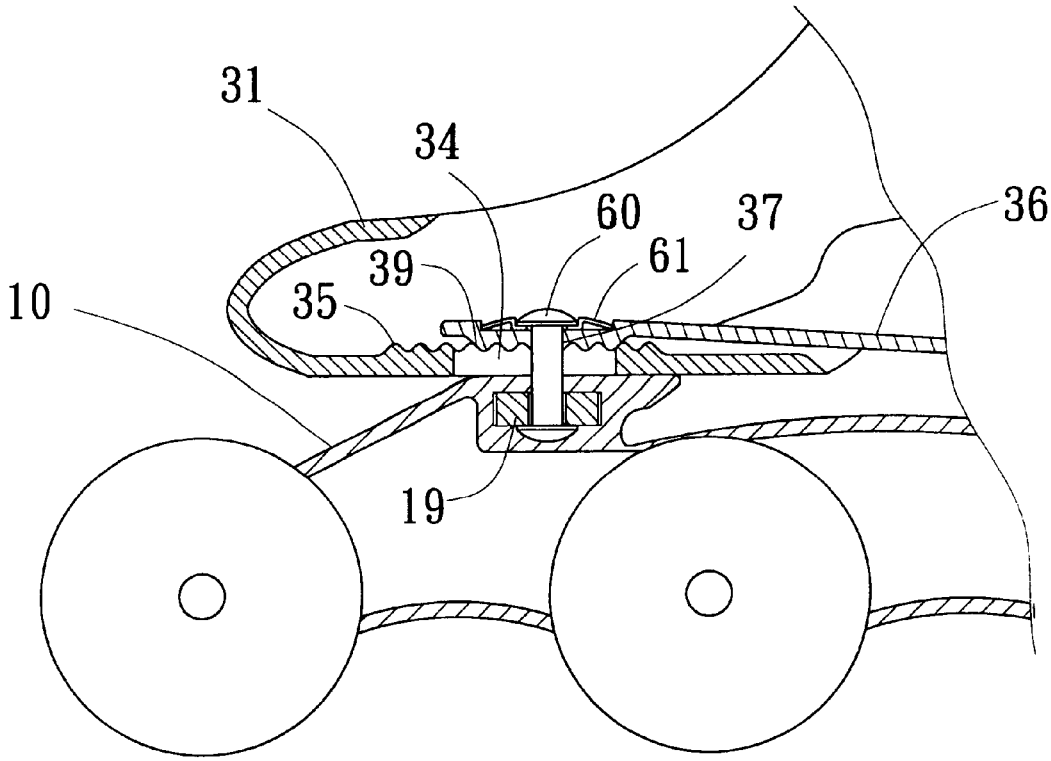
FIG. 2 is a sectional view of a part of the present invention.

The boot 30 includes a toe section 31, a heel section 36 and a cuff section 42 detachably associated by a latch assembly 50. The toe section 31 is a sheath-like body having a shape that complements the toe portion morphology of a foot. The upper edges of the two sides of the rear end of the toe portion 31 are disposed with upward extending wing sections 320, 330. The bottom of the toe section 31 and the two lateral wing portions 320, 330 are respectively formed with elongated slots 32,33, 34. As shown in FIG. 2, on the top side of the base of the front end of the toe section 31, the elongated slot 34 is provided with a transverse teeth portion 35 located around the periphery of the elongated slot 34 and extending parallel to the direction of the extension of the skate.

The heel section 36 includes a sole 172 and side walls 40 that each have holes 41. The sole includes a locating hole 38 centrally located at the rear end and a locating hole 37 centrally located at the front end. The sole is provided, around the periphery of the locating hole 37 on the bottom side of the sole 172, with a transverse teeth portion 39 that extends parallel to the direction of the extension ofthe skate.

The transverse teeth portion 39 engages with the transverse teeth portion 35.

A latch assembly 50 is provided for connecting the toe section 31, the heel section 36 and the cuff section 42. The attachment of the toe section 31, the heel section 36 and the cuff section 42 is identical for both sides of the skate. The latch assembly 50 comprises a handle 53 adapted for pivotal rotation, a threaded shaft 52 pivotally engaging the handle 53, a bushing 51 centrally forming a through hole 510 and defining a recessed area complementing the shape of the handle 53 and surrounding the bushing through hole 510, and a lug 54 having an inner threaded hole 541. The heel portion is provided with a recess around the periphery of hole 41 complementing the shape of the lug 54. the threaded shaft 52 passes through the bushing 51, the cuff section 42 at through hole 45, the toe section 31 at the elongated slot 33 and the heel section 40 at through hole 41, and is received by the inner threaded hole 541 of the lug 54. The lug 54 is riveted in the hole 41. The latching assembly 50 is manipulable and permits loosening and tightening to slidably adjust the toe portion 31 relative to the heel portion 40 and cuff portion 42, thus increasing or decreasing the size of the boot portion.

A bolt 62 and washer 63 are used to fixedly attach the rear end of the heel section 36 to the frame 10. The bolt 62 passes through the washer 63, the through hole 38 of the heel section 36, through hole 13 of the U-shaped tongue 13 and is received by the rectangular nut 99.

Figure 5:
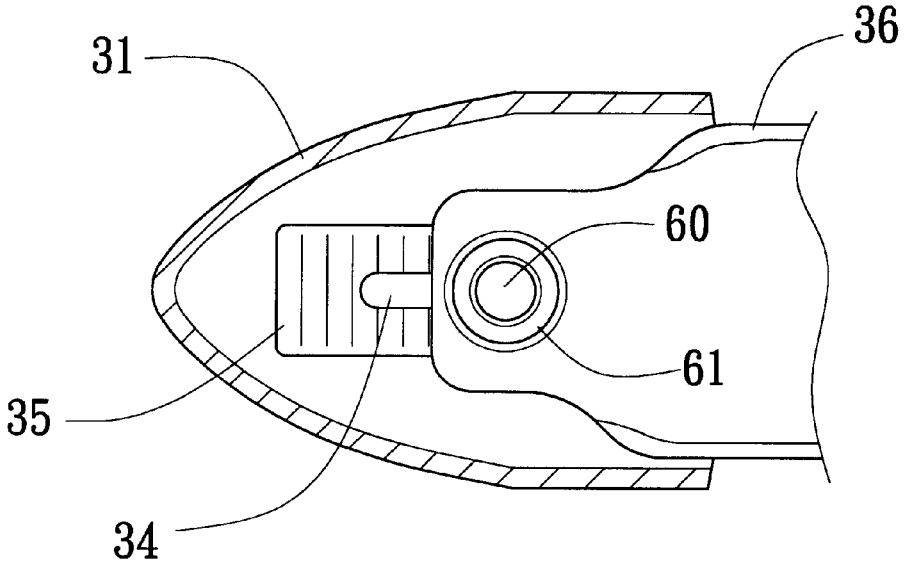
FIG. 5 is a top view showing the maximum size of the interior of the boot of the skate in FIG. 1.
Figure 6:
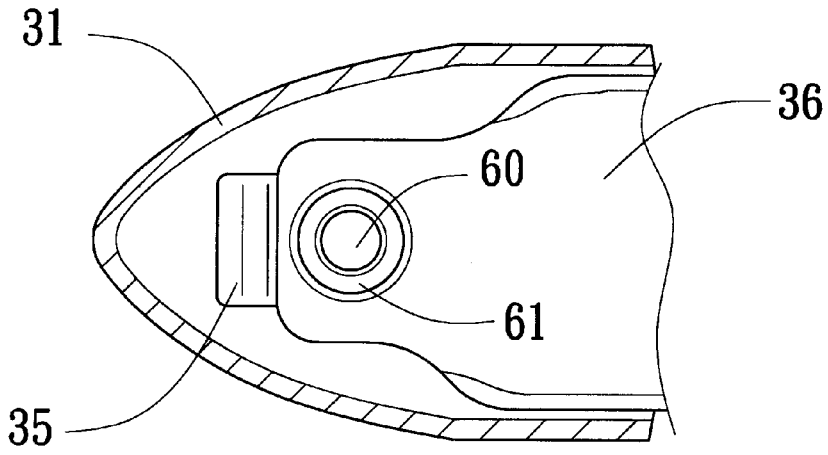
FIG. 6 is atop view showing the minimum size of the interior of the boot of the skate in FIG.1.
Figure 7:
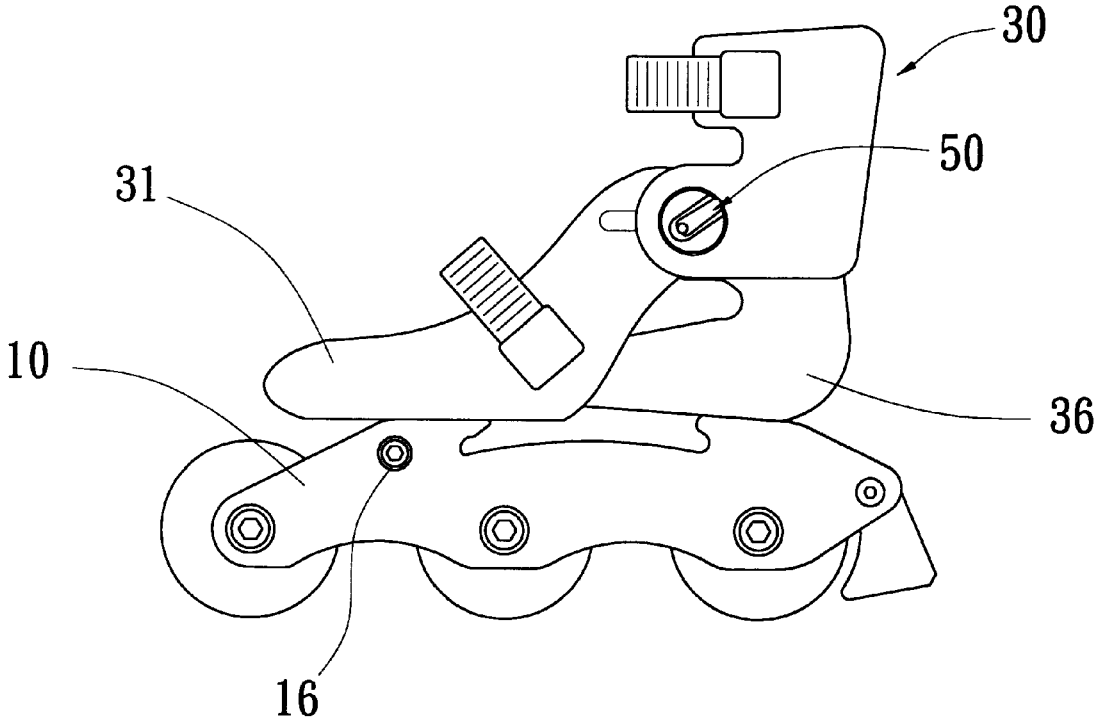
FIG. 7 is a side view of the skate in FIG. 1 showing the maximum size of the boot.
Figure 8:
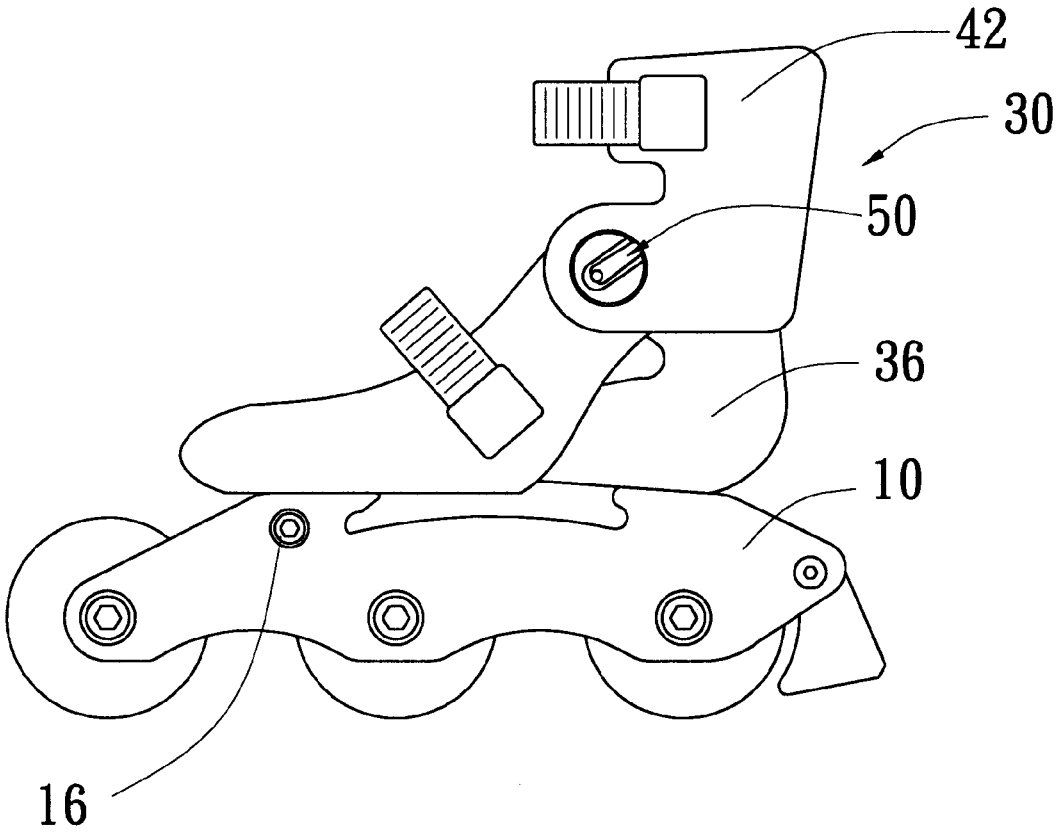
FIG. 8 is a side view of the skate in FIG. 1 showing the minimum size of the boot.
Figure 9:
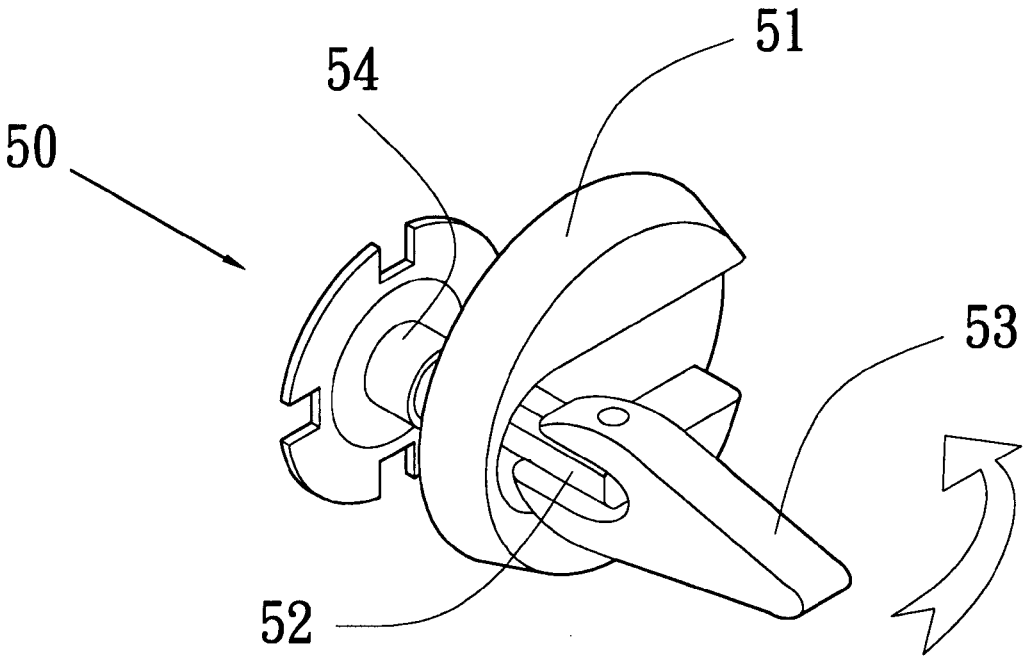
FIG. 9 shows the operation of the latch section of the skate in FIG. 1.

Referring to FIGS. 2, 3 and 4, the locating hole 37 with the transverse teeth portion 39 of the heel section 36 engages with the slide slot 34 having the transverse teeth portion 35 of the toe section 31. A pin 60 passes through a washer 61 to loosely attach the front end of the boot 30 to the insertion block 19. As shown in FIG. 3, when the adjustment fastener 16 is loosened, a gap 174 is defined between the toe section 31 and the frame 10. It follows that the spring 17 exerts an outward force onto the frame and the insertion block 19 is loosened from the insertion cavity 11 to facilitate adjustment between the transverse teeth portions 35, 39. As shown in FIGS. 5 and 6, adjustment of the transverse teeth portions 35, 39 permits either lengthening or decreasing the size of the foot length portion of the boot 30. As shown in FIG. 4, upon tightening the adjustment fastener 16, the insertion block 19 slides downward along the acute slope surfaces 11B to firmly associate the toe section 31 to the frame 10.

According to the above arrangement, the in-line skate of the present invention is adjustable in size and is provided with double tightening effect.

Having thus described the invention, changes and modifications may be made within this invention as will be apparent to those skilled in the art. Such modifications are intended to be within the scope of the invention as defined in the appended claims.

What is claimed is:

1. An extendable in-line skate structure comprising:

a frame having a first half and a second half;

a boot having a toe section, a heel section and a cuff section;

said toe section having a base and a longitudinal slot being centrally located at a mid-section of the base and provided with a first transverse teeth portion being located around the periphery of said longitudinal slot and extending parallel to a direction of the extension of said skate and;

said heel section having a sole and a first hole located at a front end of said sole and being provided with a second transverse teeth portion being located around the periphery of said first hole and extending parallel to the direction of the extension of the skate, said first transverse teeth portion cooperates with said second transverse teeth portion, wherein a pin passes through said longitudinal slot, said first hole, and is received by an insertion block disposed in an insertion cavity formed in the front end of the frame so as to connect said toe portion, said heel portion and said frame;

said heel section connecting to a rear end of said frame, said cuff section being attached to a top portion of said heel section;

said insertion cavity having inner acute slope surfaces provided at an upper portion of said frame;

said insertion block having a shape complementary to said insertion cavity;

an adjustment fastener being inserted through a third hole formed at the front end of a first frame half and being received by an elongated nut that is inserted through a fourth hole formed at a second frame half;

a spring coaxially surrounding said adjustment fastener and said elongated nut, and interposed between the frame halves so as to exert constant pressure against inner surfaces of said frame halves;

wherein said adjustment fastener, when rotated in a tightening direction, exerts a wedging effect between the surfaces of said insertion block and said insertion cavity walls so as to engage said first transverse teeth portion and said second transverse teeth portion and obtain a linkage effect between said boot and said frame while urging said spring to compress, said adjustment fastener, when rotated in a loosening direction, expanding said spring which urges movement of the insertion block so as to permit adjustment of said first transverse teeth portion and said second transverse teeth portion so as to increase or decrease the length of said boot.

2. An in-line skate structure as claimed in claim 1 further comprising a latch assembly for fastening sidewalls of said cuff portion to sidewalls of said toe portion that are secured to opposite sides of said heel portion, said latch assembly comprising:

a handle adapted for pivotal rotation;

a threaded shaft pivotally engaging said handle;

a bushing centrally forming a fifth hole and defining a recess area complementing the shape of the handle and surrounding said fifth hole;

a lug having an inner threaded hole;

wherein said threaded shaft passes through said bushing through a hole formed by said cuff portion located at a lower end, an elongated slot formed by said toe portion near an end of a sidewall portion, a hole formed by said heel portion at an end of a sidewall portion, and received by the inner threaded hole of said lug, said latching assembly releasably securing said toe portion slidable relative to said heel portion and said cuff portion along a line of travel generally parallel to a longitudinal dimension of said skate so as to be optionally tightened or loosened.

3. An in-line skate structure as claimed in claim 2 wherein said lug is riveted in the hole of said heel portion.

4. An in-line skate structure as claimed in claim 1, wherein said first frame half includes a first U-shaped tongue located near the rear end of said first frame half, said first U-shaped tongue forming a hole centrally located thereon and having a first stopping protrusion located at an end near said first frame half, said first U-shaped tongue being insertable into a complementary second U-shaped tongue having second stopper located at an end near said second frame half and forming a hole centrally located thereon, said first U-shaped tongue and said second U-shaped tongue forming a platform that defines a rectangular socket, a rectangular nut being disposed in said rectangular socket and interposed between said first stopper and said second stopper.

* * * * *